US005220235A

United States Patent [19]

Wakimizu et al.

[11] Patent Number: 5,220,235

[45] Date of Patent: Jun. 15, 1993

[54] DISCHARGE LAMP DEVICE

[75] Inventors: Yukio Wakimizu; Yasuyoshi Numajiri; Shinichi Irisawa; Masakazu Nagasawa; Yonemasa Yoshida, all of Shizuoka, Japan

[73] Assignee: Koito Manufacturing Co., Ltd., Tokyo, Japan

[21] Appl. No.: 927,722

[22] Filed: Aug. 11, 1992

Related U.S. Application Data

[63] Continuation of Ser. No. 681,027, Apr. 5, 1991, abandoned.

[30] Foreign Application Priority Data

Apr. 20, 1990 [JP] Japan ..... 2-102893
Aug. 31, 1990 [JP] Japan ..... 2-228216

[51] Int. Cl.[5] ..... H01J 5/50

[52] U.S. Cl. ..... 313/25; 313/112; 313/318; 362/255; 362/293

[58] Field of Search ..... 313/25, 112, 113, 315, 313/318; 362/255, 293; 315/73

[56] References Cited

U.S. PATENT DOCUMENTS

| | | | |
|---|---|---|---|
| 4,717,852 | 1/1988 | Debrusskin et al. | 313/112 |
| 4,810,932 | 3/1989 | Ahlgren et al. | 313/579 |
| 4,816,977 | 3/1989 | Sorensen | 313/318 |
| 4,839,553 | 6/1989 | Mellor | 313/112 |

FOREIGN PATENT DOCUMENTS

| | | | |
|---|---|---|---|
| 0045182 | 7/1981 | European Pat. Off. . | |
| 0209345 | 7/1986 | European Pat. Off. . | |
| 0376260 | 7/1990 | European Pat. Off. . | |
| 3743627 | 7/1989 | Fed. Rep. of Germany . | |
| 3904926 | 8/1989 | Fed. Rep. of Germany . | |
| 1503634 | 5/1975 | Japan . | |
| 0138845 | 7/1985 | Japan . | |
| 0053904 | 11/1987 | Japan . | |
| 0100503 | 4/1990 | Japan . | |
| 0422897 | 10/1934 | United Kingdom . | |
| 476836 | 12/1937 | United Kingdom | 313/25 |
| 2135820 | 9/1984 | United Kingdom . | |

*Primary Examiner*—Donald J. Yusko
*Assistant Examiner*—Ashok Patel
*Attorney, Agent, or Firm*—Sughrue, Mion, Zinn, Macpeak & Seas

[57] ABSTRACT

A discharge lamp device having an insulator base made of a synthetic resin integrally bonded to a globe holding member made of ceramic wherein a discharge lamp is attached. Also provided is a pair of lead supports for supporting the discharge lamp at its opposite ends. The discharge lamp and lead supports are completely surrounded by an ultraviolet ray shielding globe which is fixed to globe holding member. The globe effectively absorbs harmful ultraviolet rays having a wavelength in a predetermined wavelength range.

11 Claims, 8 Drawing Sheets

DISCHARGE LAMP DEVICE

This is a continuation of application Ser. No. 07/681,027, filed Apr. 5, 1991 now abandoned.

BACKGROUND OF THE INVENTION

The present invention relates to a discharge lamp device, and more particularly to a discharge lamp device having an ultraviolet-ray shielding globe that surrounds the discharge lamp and is secured to the front surface of a base.

Recently, much interest has been shown in discharge lamps for automotive use because of their good luminous efficiency and color rendering properties as well as long life. However, a metal halide lamp, which is one example of a discharge lamp, generates a large quantity of ultraviolet rays together with visible light rays in the light emitted from the discharge gas (e.g., mercury gas, iodide gas, or Xe gas) contained in a discharge space. Ultraviolet rays having a wavelength in the range of 240–290 nm are believed to destroy protein molecules, ultraviolet rays having a wavelength in the range of 290–320 nm are believed to be a cause of skin cancer, ultraviolet rays having a wavelength in the range of 360–370 nm destroy a resin material that is located in the circumference of the discharge lamp device. There is thus a problem because of the potential harm to the human body, making it undesirable for a person to be subjected to this kind of illumination for a long time. The resin material in the circumference of the discharge lamp is also caused to prematurely deteriorate.

One conventional technique for reducing the harmful ultraviolet rays is disclosed in Japanese Patent Application Unexamined Publication No. Sho. 60-138845. This reference teaches a structure in which an ultraviolet-ray absorbing glass tube 4 is provided on the circumference of a discharge lamp 2, as shown in FIG. 6 herein. According to another conventional technique, as disclosed in Japanese Patent Application Examined Publication No. Sho. 62-53904, a discharge lamp 2 is tightly sealed within an ultraviolet-ray absorbing glass tube 6, as shown in FIG. 7.

In the first conventional technique, despite its simple structure in which the glass tube 4 is supported through leads 5, there is a problem in how to assuredly shield/absorb ultraviolet rays because the glass tube 4 has an opening portion 4*a*.

In the second conventional technique, there is a problem in that an inert gas such as $N_2$ becomes trapped in the glass tube 6. Moreover, if the glass tube 6 is made a vacuum in order to reduce the adverse effects of temperature or pressure in the tightly sealed glass tube 6, the manufacturing equipment required and the actual manufacturing time become too expensive.

Japanese Patent Application No. Hei. 2-100503 discloses another discharge lamp. As shown in FIG. 14, a structure in which a discharge lamp 105 is supported by a pair of lead supports 103 and 104 projecting from an insulating base 102, and a cup-like ultraviolet-ray shielding globe 106 is fixed to a front surface of the base 102 by metal fittings 107. However, this approach has a problem in that the opening side of the globe is fixed to the base 102 by bending the metal fittings 107 or by fastening the outer circumference of the globe with band-like metal fittings. Therefore, because the globe cannot be easily fixed to the base, it can break if too much force is applied when fixing the globe to the base, and play (i.e., movement) may result in the fixing portion.

In consideration of the above problems, it has been proposed to integrally bond the globe to the base through an adhesive agent. In order to securely fix the globe to the base, the adhesive agent used is limited to an inorganic adhesive agent because of the high temperature associated with the discharge lamp and because the globe is made of a glass material. Assuming though that an inorganic adhesive agent is used, it is necessary to subject it to a heat treatment where the temperature reaches nearly 400° C. However, the base, which is made of synthetic resin, cannot withstand such a high temperature.

SUMMARY OF THE INVENTION

The present invention has been made in view of the above problems, and it is therefore an object of the present invention to provide a discharge lamp device which has a simple structure, can reliably absorb harmful ultraviolet rays, and in which circumferential members of the discharge lamp device are not affected by ultraviolet rays.

The above and other objects of the invention are accomplished by providing a discharge lamp device which includes a discharge lamp supported by a pair of lead supports projecting forward from an insulating base and having an ultraviolet-ray shielding globe provided on the circumference of the discharge lamp. The discharge lamp device is characterized in that the insulating base has a structure in which a globe holding portion made of ceramic is integrally attached to the front surface of a base portion made of synthetic resin. The cylindrically shaped globe has a closed forward end and is fixed to the base by the globe holding portion so that a rear-end opening portion of the globe is closed and the discharge lamp and the lead supports projecting in front of the globe holding portion are completely covered by the globe.

The ultraviolet-ray shielding globe is securely fixed at its opening end portion by the globe holding portion of the insulating base so that the ultraviolet-ray shielding globe completely covers the circumference of the discharge lamp to thereby prevent ultraviolet rays generated when the discharge lamp is on from radiating outside of the globe. Further, the globe holding portion that closes the opening end portion of the globe is made of ceramic so that the globe holding portion never deteriorates even if it is exposed to ultraviolet rays.

It is another object of the invention to provide a discharge lamp device in which an opened base-end portion of an ultraviolet-ray shielding globe is fixedly secured to a front surface of a synthetic-resin insulating base having a pair of projecting lead supports for supporting a discharge lamp so that the discharge lamp is surrounded by the ultraviolet-ray shielding globe. The discharge lamp device can be further characterized in that a ceramic globe-holding plate having lead-support insertion holes formed therein is fixed to the front surface of the base through projecting metal fittings formed on the base. The opened base-end portion of the globe is bonded to the globe holding plate through an inorganic adhesive agent.

The glass globe and the ceramic globe-holding plate are integrally bonded to each other through the inorganic adhesive agent. Further, the projecting metal fittings formed on the base are bent so as to fix the globe holding plate to the base. The globe holding plate is made of ceramic so that even if a large force is applied to the globe holding plate when bending the metal fittings, the holding plate is not damaged. Moreover, by firmly fixing the holding plate to the base, there is no movement or play at the fixing portion.

The above and other objects, features, and advantages of the present invention will become more apparent from the following detailed description taken in conjunction with the accompanying drawings.

BRIEF DESCRIPTION OF THE DRAWINGS

FIG. 12(*b*) is a sectional view of the fixture of FIG. 12(*a*);

DESCRIPTION OF THE PREFERRED EMBODIMENTS

Figure 1:
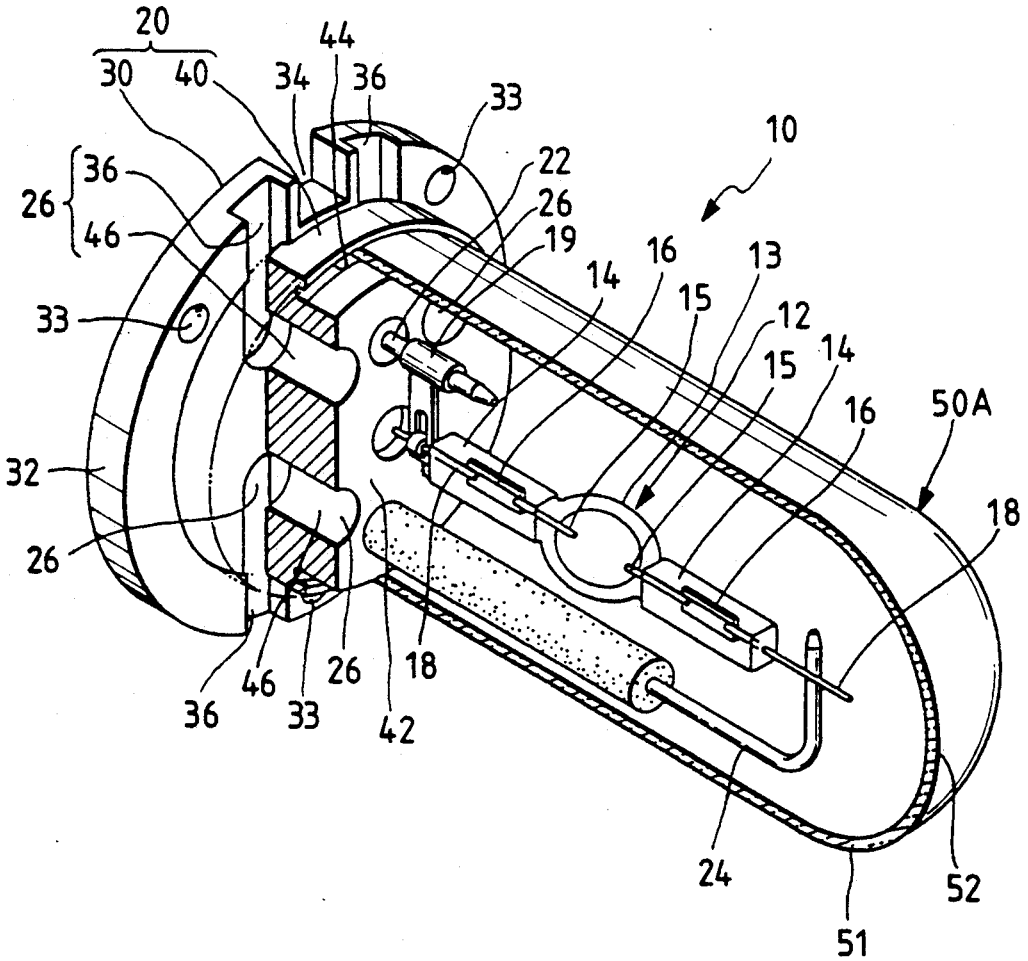
FIG. 1 is a partially cut-away perspective view of the discharge lamp device according to a first embodiment of the present invention.

Referring to FIG. 1, a discharge lamp device 10 is primarily constituted by a discharge lamp 12 (i.e., the luminous portion), lead supports 22 and 24 projecting from an insulating base 20 so as to support the discharge lamp 12, and an ultraviolet shielding globe 50A securely fixed to the insulating base 20 so as to completely cover the discharge lamp 12.

The discharge lamp 12 has a structure in which a quartz glass tube is pinched at its opposite end portions to thereby form an oval, tightly closed glass globe 13 having a discharge space formed therein and having pinched portions 14 formed at its opposite end portions. A starting rare gas, mercury and a halogenated metal are sealed in the glass globe 13. Further, discharge electrodes 15 made of tungsten are provided in opposition to each other in the discharge space, and connected to molybdenum foils 16 sealed in respective ones of the pinched portions 14. Lead wires 18 connected to the respective molybdenum foils 16 are respectively led out from the end portions of the pinched portions 14. The rear end side lead wire 18 is spot-welded to a metal support 19 fixed to the lead support 22 that projects to the front of the insulating base 20. The front end side lead wire 18 is also spot-welded to a forward bent portion of the lead support 24 that projects forward from the insulating base 20. The discharge lamp 12 is therefore structured so as to be supported at its opposite ends by the lead supports 22 and 24 through the lead wires 18.

The insulating base 20 has a structure in which a disk-shaped globe holding portion 40, made of a ceramic and having a diameter slightly smaller than that of a base portion 30, is integrally bonded to the disk-like base portion 30, which is made of a synthetic resin. A shallow concave surface 31 which engages with the globe holding portion 40 is formed in the front surface of the base portion 30. The globe holding portion 40, which is directly exposed to the emitted ultraviolet rays, is positioned to close the rear-end opening portion of the ultraviolet-ray shielding globe 50A (described later). The globe holding portion 40 is not be affected by the ultraviolet rays because the globe holding portion 40 is made of ceramic.

Figure 2:
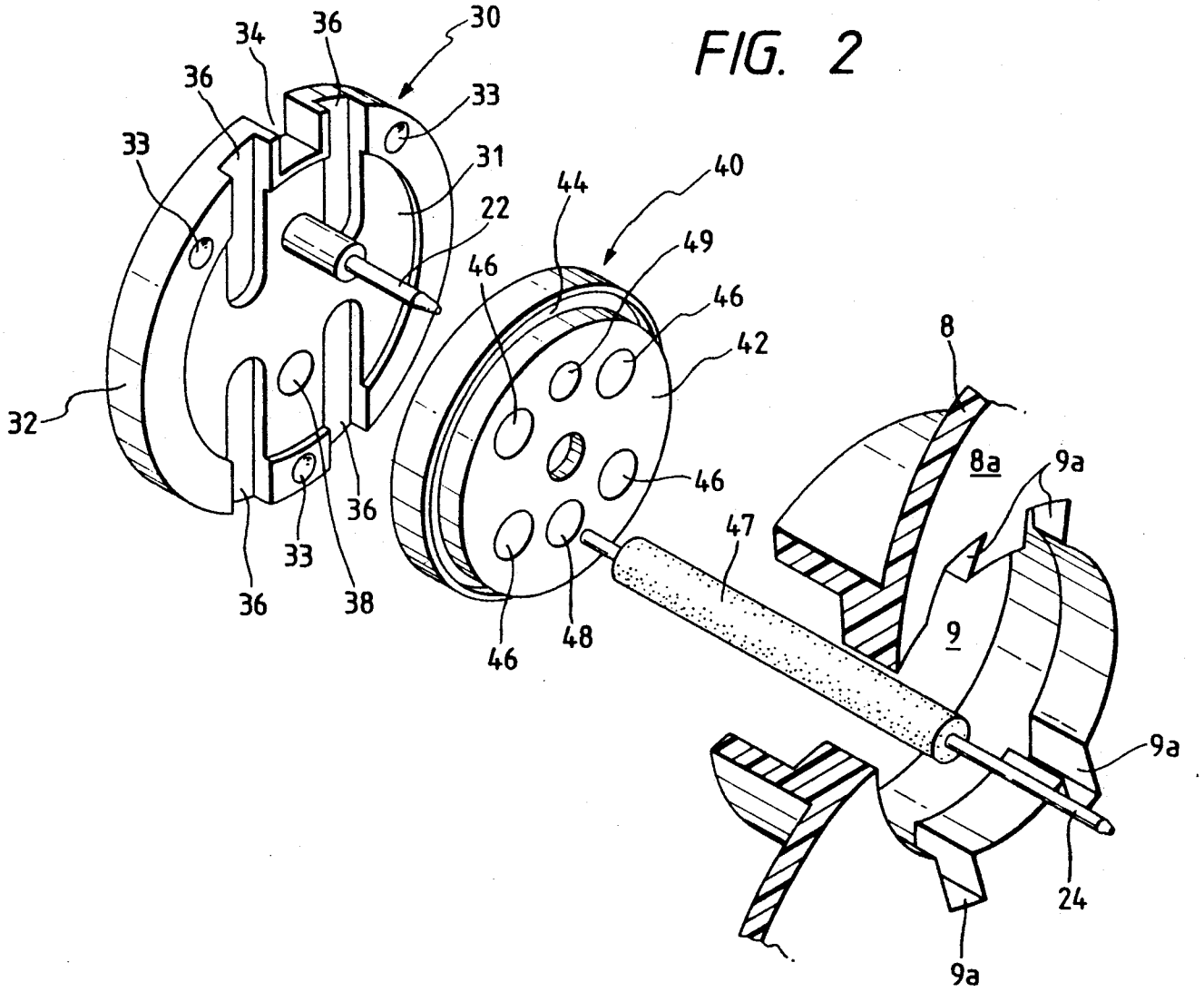
FIG. 2 is an exploded perspective view of an insulating base, which is a main portion of the lamp device of FIG. 1.

Four air vents 26 which communicate the front surface to the sides are formed in the insulating base 20. Slot portions 9*a* for forming side opening portions of the air vents 26 to be in the opened state in the front range of a reflector 8 are formed in the circumferential edge portion of a bulb insertion hole 9 of the reflector 8 (see FIG. 2). That is, although the rear end opening portion of the ultraviolet-ray shielding globe 50A is securely fixed to the globe holding portion 40 so as to tightly seal the inside of the globe 50A, the inside of the globe 50A is opened to the front-surface range of the reflector 8 through the air vents 26 to thereby create permeability between the inside and outside of the globe.

Figure 3:
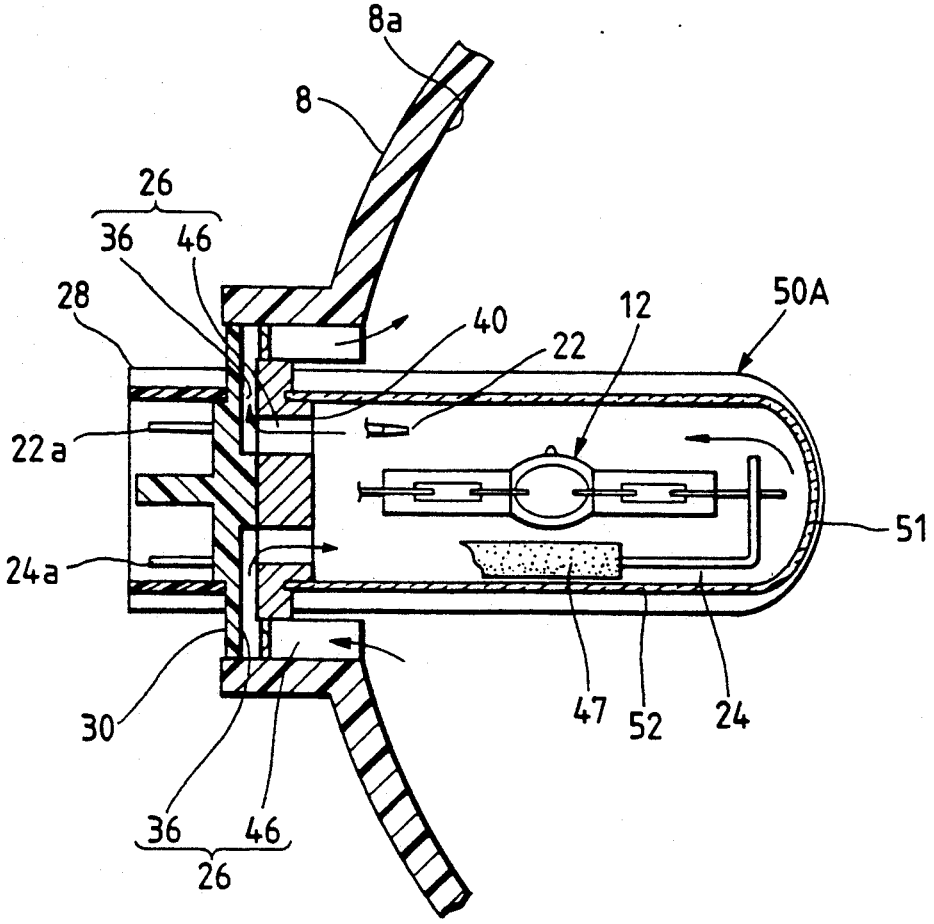
FIG. 3 is a vertical sectional view showing the state in which the lamp device is inserted in a reflector so as to be used as a bulb in a car headlamp.

Arrows in FIG. 3 indicate the convection generated through the air vents 26 between the front surface range of the reflector 8 and the inside of the globe 50A. Accordingly, the discharge lamp 12 is prevented from deteriorating in capacity and having a shortened life caused by the fact that the inside of the globe 50A is kept in the high-temperature state. Each of the air vents 26 is composed of a groove 36 on the base portion 30 side and a hole 46 on the globe holding portion 40 side. When the lamp device 10 is inserted into the bulb insertion hole 9 of the reflector 8, an outer edge portion 32 of the base portion 30 acts as a focusing ring for positioning the lamp device 10 in the front/rear and left/right directions as seen from the front relative to a light reflecting surface (a parabolic surface) 8*a* of the reflector 8. Three swelled portions 33, which are abutting reference surfaces, are formed on the front surface of the outer edge portion 32 at three circumferentially equidistant portions. Also formed in the outer edge portion 32 is a circumferential positioning slot 34 which engages with an engagement protrusion (not shown) on the reflector side when the lamp device 10 is inserted into the bulb insertion hole 9. The grooves 36 are formed in the front surface of the base portion 30 so as to constitute part of the respective air vents 26 extending from the vicinity of the central portion of the base portion to the side edge portions of the base portion.

The insert-molded lead support 22 projects from the front surface of the base portion 30. The ceramic base holding portion 40 is an outer-flanged disk-shaped body having a central disk portion 42 whose diameter is approximately the same as the inner diameter of the globe opening end portion. The central disk portion 42 projects forward so as to close the rear-end opening portion of the globe. A ring-shaped concave groove 44 is formed in the circumference of the central disk portion 42. The globe opening end-edge portion is engaged with the concave groove 44, and an adhesive agent filled in the engagement portion thereof, so that the inside of the globe 50A is tightly sealed.

The lead supports 24 and 22 are inserted through holes 38, 48 and 49 which are formed in the base portion 30 and the globe holding portion 40. The lead support 24 is inserted through a discharge-preventing insulating cylindrical body 47 made of ceramic and is fitted and adhesively fixed in the holes 38 and 48. Reference numerals **22*a* and 24*a* designate portions of the lead supports 22 and 24 which project backward from the base portion 30. The projecting portions 22*a* and 24*a* are protected by a synthetic resin cylindrical body 28 adhesively fixed to the base portion 30**.

The ultraviolet-ray shielding globe 50A has a cylindrical shape having a spherical front-end portion and an opened rear-end portion. The rear-end opening portion is fitted to the ceramic globe-holding portion 40 of the insulating base 20 and fixed thereto by an adhesive agent. The lead supports 22 and 24 and the discharge lamp 12 are completely surrounded by the globe 50A. The ultraviolet-ray shielding globe 50A has a structure in which an ultraviolet-ray shielding film 52 made of ZnO covers the outer circumferential surface of a front-end closed glass tube 51. The ultraviolet-ray shielding film 52 covering the discharge lamp 12 absorbs the ultraviolet rays generated when the discharge lamp is on, so that only visible light is emitted outside of the globe 50A.

To manufacture the ultraviolet-ray shielding film, fine particles of ZnO are dispersed in an inorganic binder (concentration of 20% to 30%), and the ZnO-dispersed material is applied onto the globe surface through a suitable method such as dipping, spray, or deposition. In order to prevent ultraviolet rays having wavelengths in range less than 370 nm from transmitted to the outside of the globe, it is necessary to make the thickness of the film not thinner than 1.6 μm. At the same time, it is desirable to select the thickness of the film to be not thicker than 5 μm to prevent the film from peeling. Further, the ultraviolet rays having a wavelength which can be absorbed varies depending on the temperature at the circumference of the globe (the absorbed wavelengths are shifted to the long wavelength side as the temperature increases), and the film is therefore adjusted so as to have a suitable thickness so that at least the ultraviolet rays having a wavelength in the range not longer than 370–380 nm can be absorbed.

The film thickness can be adjusted by changing the dipping rate or by changing the number of times of coating application or the number of times of deposition.

Although the ultraviolet-ray shielding film 52 is constituted by ZnO in the above embodiment, the ultraviolet-ray shielding film 52 may also be composed of a film made of a compound capable of absorbing ultraviolet-rays, such as $TiO_2$, CaO, or $Fe_2O_3$, although these compounds are inferior to ZnO at least with respect to absorbing ultraviolet rays.

Figure 4:
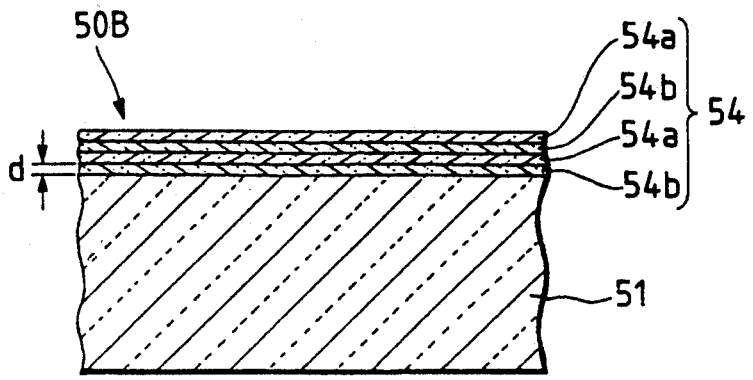
FIG. 4 is an enlarged sectional view of an ultraviolet-ray shielding film, which is a main portion of a second embodiment of the present invention.

FIG. 4 shows a main portion of a second embodiment of the present invention and is an enlarged sectional view of an ultraviolet-ray shielding globe disposed in the circumference of a discharge lamp.

Reference numeral 50B designates an ultraviolet-ray shielding globe. An ultraviolet-ray shielding film 54 formed on the outer circumference of a glass tube 51 is constituted by a dielectric multi-layer film made of compounds such as $TiO_2$, $SiO_2$, $MgF_2$, $Ta_2O_5$, etc., each of which have a different refractive index and ultraviolet-ray absorbing capabilities. The ultraviolet-ray shielding film 54 is constituted by a dielectric multi-layer film in which $SiO_2$ layers **54*a* and $TiO_2$ layers 54*b*** are alternately laminated. Ultraviolet rays having a wavelength in the range less than 360 nm are absorbed by the $SiO_2$ layers and the $TiO_2$ layers. Ultraviolet rays having a wavelength in the range from 360 nm to 380 nm are canceled with the light reflected at the boundary surfaces between the dielectric layers.

Further, the multi-layer film may have a structure in which $SiO_2$ layers and $Ta_2O_5$ are alternately laminated. In this case, the ultraviolet rays having a wavelength in the range less than 300 nm are absorbed by the respective dielectric layers, and the ultraviolet rays having a wavelength in the from 300 nm to 380 nm are canceled with the reflected light at the boundary surfaces between the respective dielectric layers.

Alternatively, the multi-layer film may have a structure in which $TiO_2$ layers and $MgF_2$ layers are alternately laminated. That is, a film thickness of each of the dielectric layers (for example, **54*a* and 54*b***) is set to $d=n/4\lambda$ (where, $\lambda$ is the wavelength to be canceled, n: is the refractive index of the dielectric). If the film's thickness d is selected to be a suitable value, the phase of the light reflected at the boundary surfaces between the respective dielectric layers is inverted against the phase of incident light, and the reflected light acts to cancel the ultraviolet rays having the wavelength $\lambda$.

Figure 5:
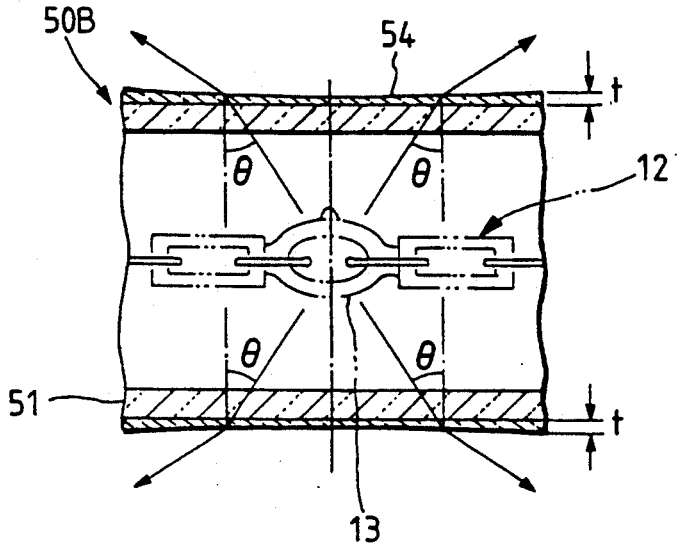
FIG. 5 is a sectional view illustrating the adjusting of a film thickness of the ultraviolet-ray shielding film.
Figure 6:
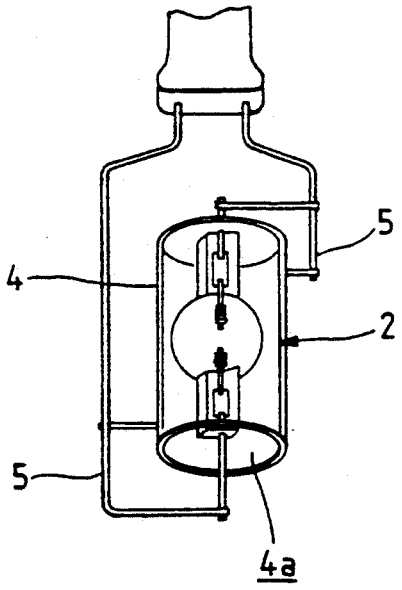
FIG. 6 PRIOR ART
FIGS. 6 and 7 perspective views showing conventional techniques.
Figure 7:
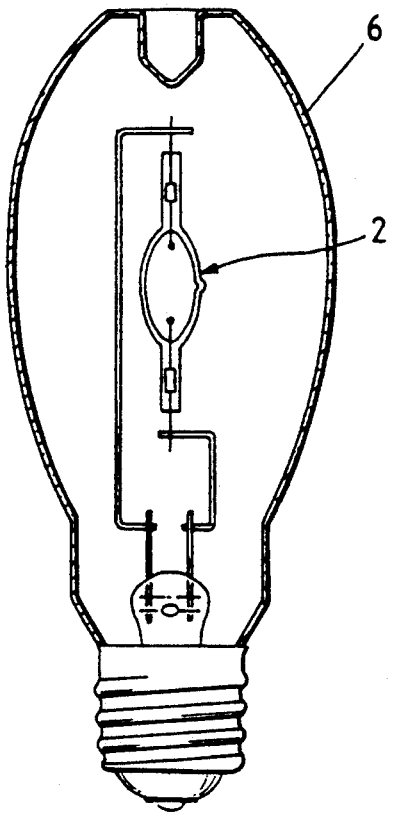
FIG. 7 PRIOR ART

Further, the thickness of the dielectric layer is made thicker as the distance between the glass bulb 13 and the dielectric layer increases to thereby prevent the wavelength range of the ultraviolet rays which are to be absorbed from varying. That is, the wavelength range of the ultraviolet rays absorbed in the ultraviolet-ray shielding film is shifted to the shorter wavelength side in proportion to the incident angle of the light into the ultraviolet-ray shielding film. Accordingly, in the case where the film thickness t of the ultraviolet-ray shielding film (the dielectric multi-layer film) 54 is made even in the longitudinal direction of the globe, there is a problem in that the ultraviolet-ray absorbing function is poor in the front and rear end positions of the globe. More specifically, the incident angle $\theta$ of the light into the ultraviolet-ray shielding film is large in a position closer to the front and rear end portions of the globe compared with that in a central region of the globe in which the light incident angle is nearly zero, so that the ultraviolet-ray cutting function is inferior. Then, as shown in FIG. 5, the thickness t of the ultraviolet-ray shielding film 54 is made larger by making each of the dielectric layers thicker at the front and rear end portions of the globe so that the absorption of the ultraviolet rays remains substantially uniform in the longitudinal direction of the globe.

Although a structure in which the ultraviolet-ray shielding film 52, 54 is formed on the outside of the globe has been described with respect to the two embodiments mentioned above, the ultraviolet-ray shielding film may be formed on the inside of the globe or may be formed both on the inside and outside of the globe.

In the case where the discharge lamp device according to the present invention is used as a light source for a car headlamp, a light-shielding coating portion for shielding light directly emitted from the discharge lamp is formed on the front end portion of the front-end closed glass tube, and the ultraviolet-ray shielding film 52 or 54 may be formed on the glass tube, except for the light-shielding coating portion.

Further, although the case has been described where the ultraviolet-ray shielding globe has a structure in which the glass tube 51 is coated with the ultraviolet-ray shielding film 52 or 54, the globe may be made, for example, of soda glass, hard glass, alumina silicate glass, or the like which has an ultraviolet-ray absorbing function.

As apparent from the above description of the discharge lamp device according to the present invention, the opening end portion of the globe is securely fixed to the globe holding portion of the insulating base, and the circumference of the discharge lamp is completely covered by the ultraviolet-ray shielding globe, so that the ultraviolet-ray shielding globe prevents ultraviolet rays generated when the discharge lamp is on from radiating outside of the globe. Therefore, there is no problem in ultraviolet rays being generated by the discharge lamp as in the conventional discharge lamp device. Further, the globe holding portion of the insulating base for closing the opening end portion of the globe is made of ceramic so as to not change in quality even if ultraviolet rays are radiated onto the globe holding portion. As a result, the endurance of the discharge lamp device is improved.

Figure 8:
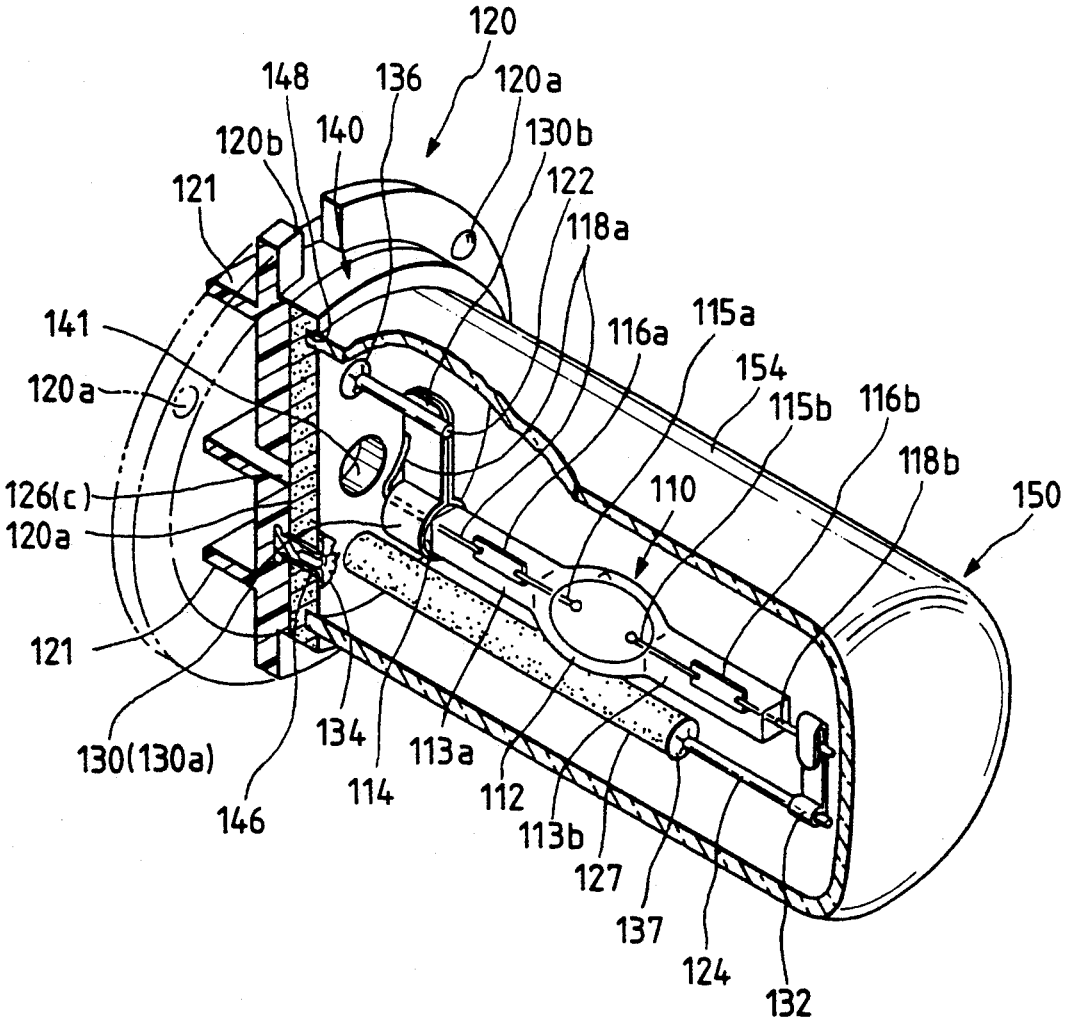
FIG. 8 is a partially cut-away perspective view showing a discharge lamp device according to a third embodiment of the present invention.
Figure 9:
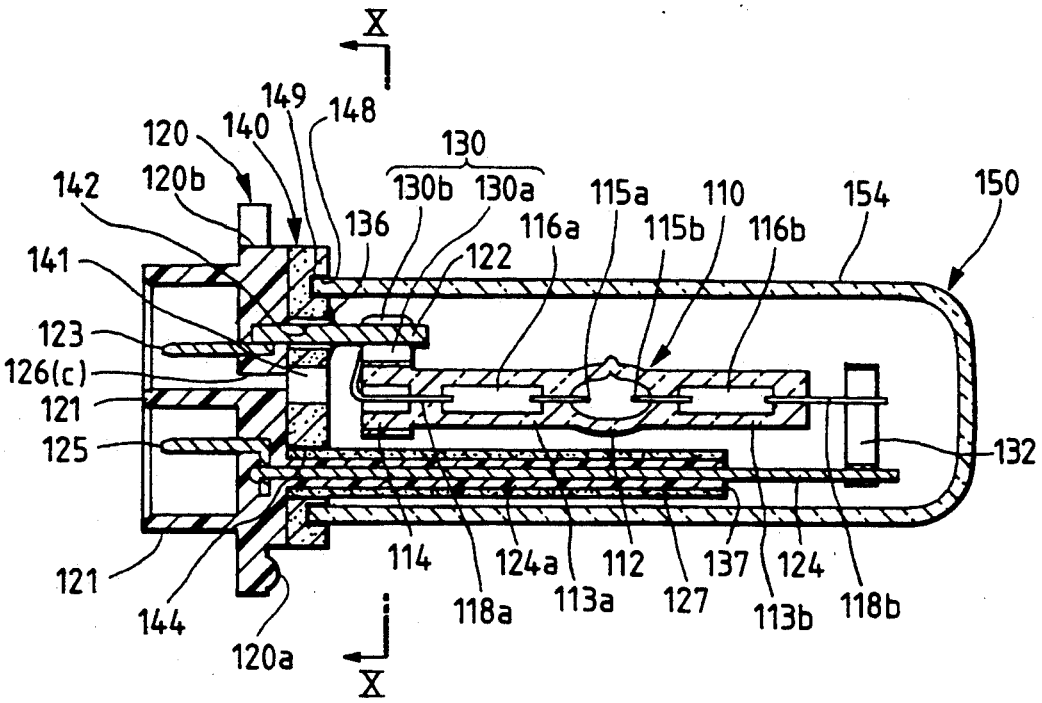
FIG. 9 is a vertical sectional view of the lamp device of FIG. 8.
Figure 10:
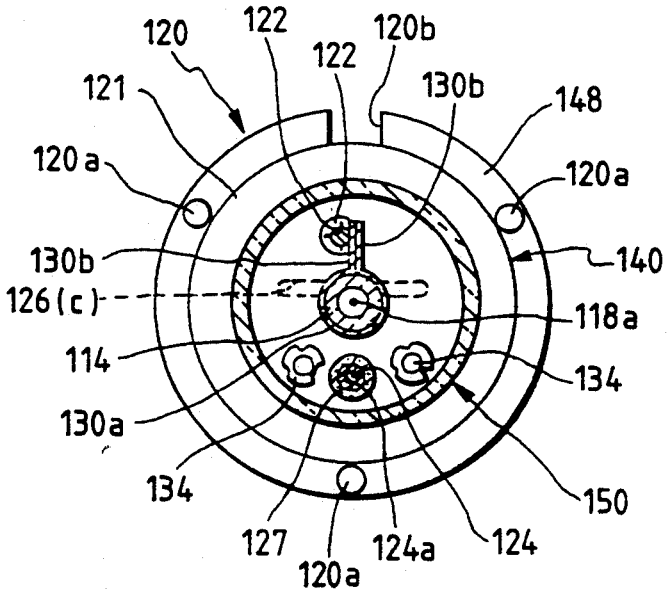
FIG. 10 is a sectional view taken on a line X—X shown in the vertical sectional view of the lamp device of FIG. 9.

FIGS. 8 through 12 are views showing a third and fourth embodiment of the present invention. FIG. 8 is a partially cut-away perspective view of a discharge lamp device, FIG. 9 is a vertical sectional view of the lamp device, FIG. 10 is a sectional view taken on a line X—X in FIG. 9, FIGS. 11(*a*) and 11(*b*) are respective sectional views of a globe-holding-plate fixing rivet illustrating the state in which the front end of the rivet is bent, FIG. 12(*a*) is an enlarged perspective view of a globe-holding-plate fixing fixture, and FIG. 12(*b*) is a sectional view of the fixture.

The discharge lamp device of the third and fourth embodiments is similarly constituted as the first and second embodiments. The discharge lamp device is primarily constituted by a discharge lamp 110 (i.e., the light-emission portion), lead supports 122 and 124 projecting from an insulating base 120 of a lamp holder for supporting the discharge lamp 110, a globe holding plate 140 integrally fixed to the front surface of the insulating base 120, and an ultraviolet-ray shielding globe 150 bonded to the globe holding plate 140 so as to surround the discharge lamp 110.

The discharge lamp 110 has a structure in which a quartz glass tube is pinched at its opposite end portions so that pinch seal portions 113*a* and 113*b* each having a rectangular cross section are formed at opposite end portions of an oval closed glass globe 112, which forms a discharge space therein. A starting rare gas (e.g., mercury and metal halide) is sealed in the glass globe 112. A non-pinch-sealed, circular pipe-shaped extended portion 114 is integrally formed at the one pinch seal portion 113*a*, and held by a metal support 130 (which will be described below). Discharge electrodes 115*a* and 115*b* made of tungsten are mounted in the discharge space so as to be opposite to each other, and are connected to molybdenum foils 116*a* and 116*b* sealed in the pinch seal portions 113*a* and 113*b*, respectively. Lead wires 118*a* and 118*b* connected to the molybdenum foils 116*a* and 116*b*, respectively, are led out from the end portions of the pinch seal portions 113*a* and 113*b*, respectively. The lead wire 118*a* extends to the outside through the extended portion 114. The discharge lamp 110 is supported at its opposite ends through the metal supports 130 and 132 by a pair of long and short lead supports 122 and 124 which are inert-molded to the insulating base 120 and project forward therefrom.

The insulating base 120 is a disk-shaped molded body made of a synthetic resin material such as PPS. Connector male terminals 123 and 125 integrally welded with the lead supports 122 and 124 project from the rear side of the base 120. The terminals 123 and 124 are surrounded by a rectangular pipe-shaped extended bulkhead 121, so that no discharge occurs between the terminals 123 and 124. An integrated body of the terminal 123 and the lead support 122, and an integrated body of the terminal 125 and the lead support 124 are integrated with the insulating base 120 through insertion molding. A forward/backward penetrating hole 126 is formed in the base between the lead supports 122 and 124, and, as will be described, the base 120 attains a large dielectric strength.

The hole 126 formed in the base 120 extends so as to cross a portion between the terminal 123 and the terminal 125, and consequently the total dielectric strength of the base including the hole formed therein is lowered because the air hole 126(*c*) has a dielectric strength much lower than that of the base without the hole. However, in order to compensate for this, the hole-forming wall surface is pressed tightly against a metal mold at the time of molding the base 120, thereby increasing the material density of the circumferential edge of the hole. Accordingly, the increased density results in a higher dielectric strength for the base, which more than adequately compensates for the decrease in dielectric strength due to the base having the air layer 126(*c*) formed therein. As a result, the total dielectric strength is higher than that in the case where the penetrating hole 126 is not formed, and practically no discharge is generated between the terminals 123 and 125.

Further, the hole 126 communicates to the inside of the globe 150 through forward/backward a penetrating hole 141 formed in a globe holding plate 140 which will be described later, so that air is actively caused to flow between the inside and outside of the globe to thereby accelerate the discharge operation in the globe 150.

A pair of rivets 134 are integrated with the base through insertion molding and project from the front surface of the base 120 to affix the globe thereto. The ceramic disk-shaped globe holding plate 140 is securely fixed to the base front surface by the rivets 134. A pair of lead-support insertion holes 142 and 144 are formed in the globe holding plate 140, and further a pair of rivet insertion holes 146 are formed in the globe holding plate 140 on the opposite sides of the insertion hole 144. The lead supports 122 and 124 project from the insertion holes 142 and 144, and the circumferential edge portions of the rivet insertion holes are fixed by bending the rivets 134. That is, as shown in FIG. 11(*a*), each of the rivets 134 has a structure in which a solid base end portion 134*a* is embedded in the base and a forward-end hollow cylindrical portion 134*b* projects from the base.

Figure 11A:
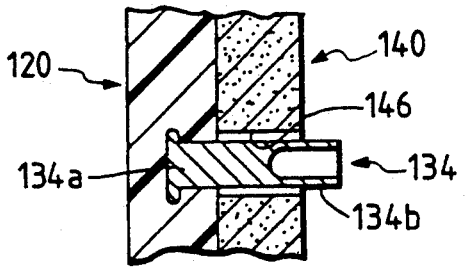
FIGS. 11(*a*) and 11(*b*) are sectional views of rivets for fixing globe holding plates.
Figure 11B:
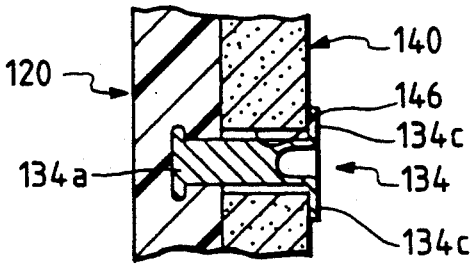

As shown in FIG. 11(*b*), the hollow cylindrical portions 134*b* are pressed so as to expand to the outside and then broken by the use of a jig (not shown) to the state where the hollow cylindrical portions 134*b* project from respective ones of the rivet insertion holes 146. The circumferential edge portions of the rivet insertion holes are fixed by bending the bent portions 134*c* of the cylindrical portions 134*b*.

Figure 12A:
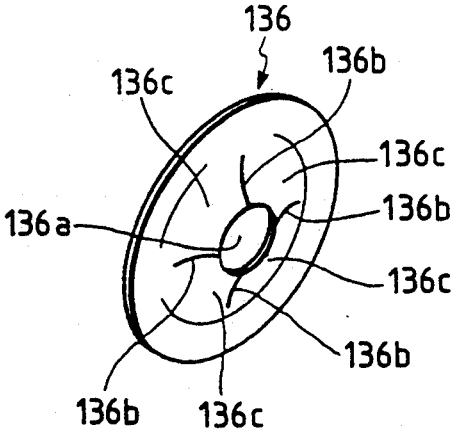
FIG. 12(*a*) is an enlarged perspective view of a globe-holding-plate fixing fixture.
Figure 12B:
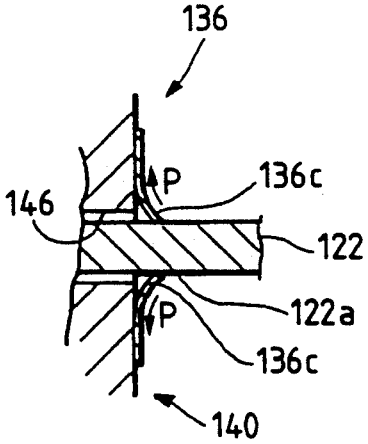

A fixture 136, shown in FIGS. 12(*a*) and 12(*b*), which is a metal fitting for fixing the holding plate, is mounted on the lead support 122 so as to pressingly fix the circumferential edge portion of the lead support insertion hole against the base side. That is, the fixture 136 is a thin-plate disk-shaped body having a lead-support insertion hole formed therein, and has a structure in which four plate-spring-shaped bent pieces 136*c* divided by radially extending slits 136*b* are formed around the hole 136*a*. The forward end portion of each of the divisional pieces 136*c* is engaged with an outer circumferential convex-concave portion 122*a* of the lead support 122, so that the circumferential edge portion of the lead support insertion hole 136*a* is fixedly held by the urging force (see arrows P in FIG. 12(*b*)) of the divisional pieces 136*c* against the base side. Reference numeral 127 designates a discharge-preventing insulating cylindrical body made of ceramic which is fitted on an outer circumference of a coated portion 124*a* of the lead support 124. A fixture 137 having the same structure as that of the fixture 136 is also mounted between the insulating cylindrical body 127 and the lead support 124, so that the insulating cylindrical body 127 is fixedly held by the lead support 124.

The metal support 130 has a structure in which a belt-shaped metal plate has a predetermined width and a circular-pipe-shaped form. An arc-shaped lamp holding portion 130*a* and plate-shaped flange portions 130*b* are made to abut one another so that the extended portion 114 of the discharge lamp is held by the lamp holding portion 130*a*. One of the flange portions 130*b* is spot-welded to the forward end portion of the lead support 122. Accordingly, in the holding portion 130*a*, the discharge lamp 110 can easily slide in the axial direction (i.e., left/right direction in FIG. 8) and in the circumferential direction (i.e., the circumferential direction of the cylindrical holding portion), and it is therefore easy to adjust the position of the discharge lamp 110 relative to a reflector (not shown).

The rear-end-side lead wire 118*a* led out from the inside of the extended portion 114 of the discharge lamp is spot-welded to the metal support 130. In the metal support 132 supporting the front end portion of the discharge lamp 110, a belt-shaped metal plate having a predetermined width is molded similarly to the metal support 130. One end portion of the metal support 132 is spot-welded to the forward end portion of the lead support 124, while the other end portion is bent so as to sandwich the front-end-side lead wire 118*b* and is also spot-welded.

Reference numeral 150 designates a cylindrical cup-shaped transparent-glass ultraviolet-ray shielding globe having a closed front end. The base end portion of the opening side of the globe is firmly bonded through an inorganic adhesive agent 149 to a globe engagement groove 148 of the globe holding plate 140. An ultraviolet-ray shielding film 154 made of ZnO covers the outer surface of the globe. Accordingly, because the globe 150 is securely fixed to the base 120, the ultraviolet-ray shielding film 154, surrounding the discharge lamp 110, absorbs the ultraviolet-rays generated when the discharge lamp 110 is turned on so that only visible light (i.e., no ultraviolet rays) is transmitted outside of the globe 150. In order to eliminate any permeability of ultraviolet-rays having a wavelength in a range less than 370 nm, the film thickness should not be thinner than 1.6 μm, and to also prevent the film from peeling, the film-thickness should not e thicker than 5 μm. Since the wavelength range in which ultraviolet rays can be absorbed varies depending on the temperature surrounding the globe (the absorbed wavelengths shift so as to be longer at high temperatures), the film is made to have a thickness corresponding to which ultraviolet rays having wavelengths in the range of at least 370–380 nm are absorbed. The ultraviolet-ray shielding film can be formed through a coating method such as dipping, deposition or spraying. If the shielding film is formed by the dipping method, the film thickness can be adjusted by changing the rate in which the globe is dipped, or by simply changing the number of dipping cycles. Similarly, in the other film-thickness adjusting methods, the film thickness can be varied by increasing the number of times of deposition or spraying.

Reference numeral 120*a* designates protrusions provided on the front surface of the circumferential edge portion of the insulating base 120 for forward/backward positioning a bulb (i.e., a discharge lamp device). The protrusions 120*a* abut a wall surface of a bulb insertion hole (not shown), so that the bulb is positioned in the forward/backward direction of an optical axis.

Reference numeral 120*b* designates a slot provided in the insulating base 120 at its circumferential edge portion for performing circumferential positioning. When a bulb (i.e., a discharge lamp device) is inserted into a bulb insertion hole (not shown), a protrusion on the bulb insertion hole side engages with the slot 120*b* so as to circumferentially position the bulb.

In order to assemble the discharge lamp device, the globe holding plate 140 is first assembled to the base 120 wherein the rivets 134 and the lead supports 122 and 124 are insert-molded, the rivets 134 are bent, the fixture 136 is mounted, and the holding plate 140 is fixed to the base 120. Next, the insulating body 127 is inserted through the lead support 124 so as to be fitted into the lead support insertion hole 144, and the fixture 137 is mounted so as to fix the insulating body 127 to the lead support 124. Thereafter, the discharge lamp 110 is fixedly welded to the lead supports 122 and 124 through the metal supports 130 and 132. Next, the adhesive agent 149 is applied into the globe engagement groove 148 of the holding plate 140 so as to engagement-bond the globe 150 thereto. Finally, the engagement portion is subjected to a baking treatment.

Figure 13:
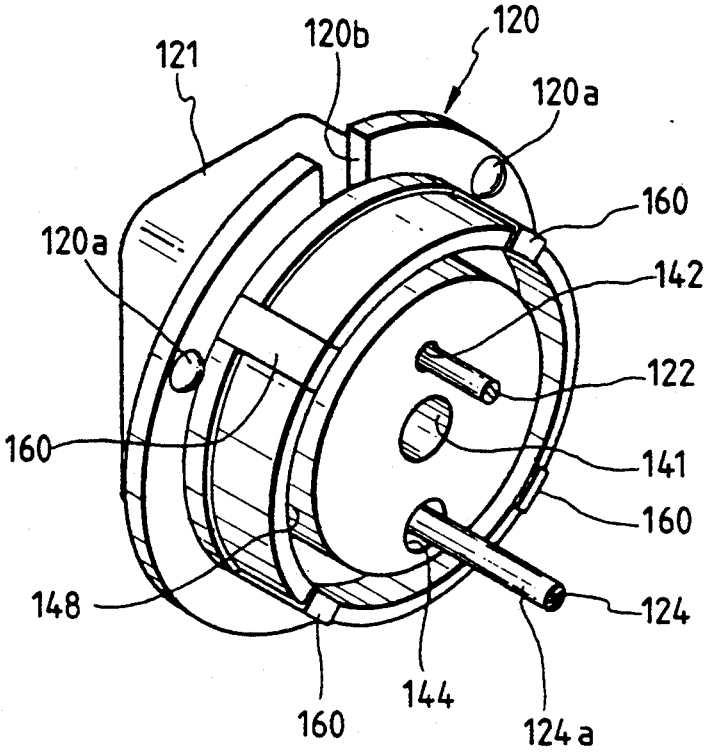
FIG. 13 is a perspective view showing the main portion of the discharge lamp device of a fourth embodiment of the present invention.
Figure 14:
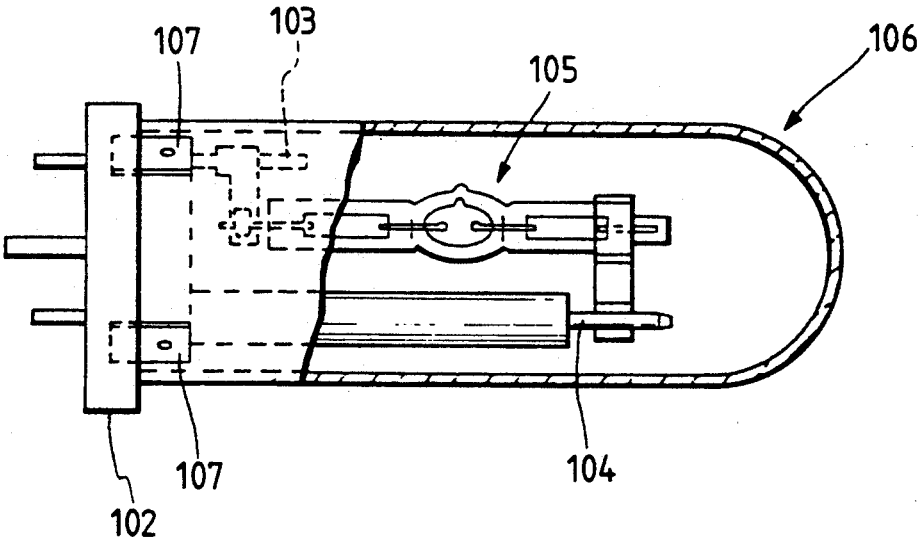
FIG. 14 is a vertical sectional view of an earlier discharge lamp device.

FIG. 13 is a perspective view of a main portion of the discharge lamp device of a fourth embodiment of the present invention. The discharge lamp device is in the state in which a holding plate made of ceramic is fixed to an insulating base.

The fourth embodiment has a structure in which four metal pieces 160 fixed to the insulating base 120 through insert-molding are projected from the front surface of the base 120, and the forward ends of the metal pieces 160 are bent so as to fix the outer circumferential edge of the globe holding plate 140 to the base 120.

Although the forward end of the ultraviolet-ray shielding globe is closed and cup-shaped in the above embodiment, the ultraviolet-ray shielding globe may have a cylindrical shape having opposite end portions opened.

As is apparent from the above description of the discharge lamp device in accordance with the present invention, the ceramic holding plate integrally bonded to the opened base end portion of the ultraviolet-ray shielding globe is securely fixed to the base by projecting metal fittings formed on the insulating base, so that no play or movement occurs in the portion where the ultraviolet-ray shielding globe is fixed to the base. Further, the ultraviolet-ray shielding globe and the globe holding plate can be bonded to each other through an inorganic adhesive agent and through heat treatment at a high temperature without being affected by a synthetic resin member which is cannot easily withstand such a high temperature, so that the bond of the globe can be made firm.

There has thus been shown and described a novel discharge lamp device which fulfills all the objects and advantages sought therefor. Many changes, modifications, variations and other uses and applications of the subject invention will, however, become apparent to those skilled in the art after considering the specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. A discharge lamp device comprising: a discharge lamp; an insulating base member comprising a globe holding portion made of ceramic integrally fixed to a front surface of a base portion made of synthetic resin; an ultraviolet ray shielding globe surrounding said discharge lamp, said globe having a closed forward end portion and an open rearward end portion; and a pair of lead supports projecting forward from said insulating base member for supporting said discharge lamp, wherein said open rearward end portion of said globe is fixed to said globe holding portion so that said open globe is fixed to said globe holding portion so that said open rearward end portion is closed and said discharge lamp and said pair of lead supports are completely covered.

2. The discharge lamp device as claimed in claim 1, wherein said globe is covered with an ultraviolet ray absorbing film for absorbing ultraviolet rays emitted by said discharge lamp.

3. The discharge lamp device as claimed in claim 1, wherein said globe is cylindrically shaped.

4. The discharge lamp device as claimed in claim 1, wherein said lead supports support said discharge lamp at the opposite ends of said discharge lamp.

5. The discharge lamp device as claimed in claim 1, wherein a plurality of air vents are provided communicating from said front surface side of said base to a side of said base for providing permeability between the inside and outside of said globe.

6. The discharge lamp device as claimed in claim 5, wherein said base portion has formed therein at least one groove and said globe holding portion has formed therein at least one hole, said at least one groove and said at least one hole being arranged such as to form said plurality of air vents.

7. The discharge lamp device as claimed in claim 1, wherein said base portion and said globe holding portion have holes formed therein for inserting said pair of lead-supports therethrough, said pair of lead-supports being inserted through an insulator cylindrical body thereby preventing any of said ultraviolet rays from being emitted to said outside of said globe via said base portion and said globe holding portion holes.

8. The discharge lamp device as claimed in claim 7, wherein said insulator cylindrical body is made of ceramic and is adhesively fixed to said holes of said base portion and said globe holding portion.

9. The discharge lamp device as claimed in claim 2, wherein said ultraviolet ray shielding film is a multi-layer film, said multi-layer film absorbing a first set of ultraviolet rays having a predetermined wavelength and causing the cancellation of a second set of ultraviolet rays having a second predetermined wavelength.

10. The discharge lamp device as claimed in claim 2, wherein a thickness of said ultraviolet ray shielding film varies along a longitudinal direction of said globe so that absorption of said ultraviolet rays remains uniform along said longitudinal direction of said globe.

11. A discharge lamp device comprising: a discharge lamp; an insulating base member made of synthetic resin having formed to a front surface thereof metal fittings for fixing to said front surface a globe-holding plate made of ceramic by bending said metal fittings, said globe-holding plate having lead-support insertion holes formed therein; a pair of lead supports for supporting said discharge lamp projecting from said insulating base member through said lead-support insertion holes of said globe-holding plate; and an ultraviolet ray shielding globe for surrounding said discharge lamp, said globe having an open end portion, said open end portion being fixedly bonded to said globe holding plate by an inorganic adhesive agent; wherein ultraviolet rays emitted by said discharge lamp are completely absorbed by said ultraviolet ray shielding globe and prevented from being emitted to the outside of said globe.

* * * * *